US008374527B2

(12) United States Patent
Ohta et al.

(10) Patent No.: US 8,374,527 B2
(45) Date of Patent: Feb. 12, 2013

(54) DEVELOPER STORING BODY HAVING A MOVABLE OUTLET SHUTTER MEMBER, IMAGE FORMING UNIT AND IMAGE FORMING APPARATUS

(75) Inventors: Atsushi Ohta, Tokyo (JP); Yukiyoshi Oda, Tokyo (JP); Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 469 days.

(21) Appl. No.: 12/662,070

(22) Filed: Mar. 30, 2010

(65) Prior Publication Data

US 2010/0247160 A1 Sep. 30, 2010

(30) Foreign Application Priority Data

Mar. 31, 2009 (JP) ..... 2009-087635

(51) Int. Cl.
*G03G 15/08* (2006.01)

(52) U.S. Cl. ..... 399/260

(58) Field of Classification Search ..... 399/106, 399/258, 260, 262
See application file for complete search history.

(56) References Cited

U.S. PATENT DOCUMENTS

| | | | | |
|---|---|---|---|---|
| 6,289,193 | B1 * | 9/2001 | Ban et al. | 399/258 |
| 2006/0210319 | A1 | 9/2006 | Katsuyama | |

FOREIGN PATENT DOCUMENTS

| | | | |
|---|---|---|---|
| EP | 0 915 391 | A2 | 5/1999 |
| EP | 0 915 391 | A3 | 3/2000 |
| EP | 1 184 741 | A2 | 3/2002 |
| EP | 2 003 513 | A1 | 12/2008 |
| GB | 2 244 677 | A | 12/1991 |
| JP | 2000-181224 | A | 6/2000 |
| JP | 2001-228693 | | 8/2001 |
| JP | 2005-82152 | | 3/2005 |
| JP | 2006-259343 | | 9/2006 |

* cited by examiner

*Primary Examiner* — William J Royer
(74) *Attorney, Agent, or Firm* — Rabin & Berdo, P.C.

(57) ABSTRACT

A developer storing body is detachably attached to an image forming unit main body of an image forming unit. The developer storing body includes a cartridge main body for storing a developer. The cartridge main body has a developer outlet opening through which the developer is ejected. The developer storing body includes an outlet shutter member movable with respect to the cartridge main body so as to open and close the developer outlet opening. A movable direction of the outlet shutter member is substantially the same as a direction in which the developer storing body is attached to or detached from the image forming unit main body.

18 Claims, 13 Drawing Sheets

DEVELOPER STORING BODY HAVING A MOVABLE OUTLET SHUTTER MEMBER, IMAGE FORMING UNIT AND IMAGE FORMING APPARATUS

BACKGROUND OF THE INVENTION

The present invention relates to a developer storing body, a developing device, an image forming unit and an image forming apparatus.

A general image forming apparatus such as a printer, a copier, a facsimile machine or a combined machine is configured to form a toner image by uniformly charging a surface of a photosensitive drum using a charging roller, exposing the surface of the photosensitive drum using an LED head to thereby form a latent image, and developing the latent image using a developing unit. The developing unit includes a developing roller, a toner supplying roller, a developing blade or the like. A toner as a developer is supplied to the developing roller by means of the supplying roller, and a thin toner layer is formed on the surface of the developing roller by means of the developing blade. The toner on the developing roller adheres to the surface of the photosensitive drum, and develops the latent image to form a toner image.

The toner image on the surface of the photosensitive drum is transferred to a sheet by means of a transferring roller, and then the toner image is fixed to the sheet by means of a fixing unit.

The photosensitive drum, the charging roller, the developing roller, the toner supplying roller, the developing blade and the like constitute an image forming unit. A toner cartridge is detachably attached to a main body of the image forming unit (i.e., an image forming unit main body) for supplying the toner to the image forming unit main body. The toner cartridge is replaced when the toner stored in the toner cartridge is used up.

The toner cartridge includes a toner outlet opening disposed at a bottom of a cartridge main body. Further, a shutter is rotatably provided inside the toner cartridge to open and close the toner outlet opening. The shutter has a shutter opening corresponding to the toner outlet opening. The toner outlet opening is opened when the shutter opening is aligned with the toner outlet opening, and is closed when the shutter opening is not aligned with the toner outlet opening. The shutter further includes an operating portion which is to be operated by an operator for opening and closing the toner outlet opening. When the operating portion is operated by the operator, the shutter rotates to open or close the toner outlet opening, and causes the toner cartridge and the image forming unit main body to engage each other or disengage from each other.

A replacing operation of the toner cartridge is performed as follows. First, the operator operates the operating portion of the shutter to close the toner outlet opening of the toner cartridge (attached to the image forming unit) by means of the shutter, and to release engagement between the toner cartridge and the image forming unit main body. Then, the operator detaches the toner cartridge from the image forming unit main body while holding a grip portion of the toner cartridge. Thereafter, the operator attaches a new toner cartridge to the image forming unit main body. Then, the operator operates the operating portion of the shutter to cause the new toner cartridge and the image forming unit main body to engage each other, and to open the toner outlet opening for example, Japanese Laid-Open Patent Publication No. 2000-181224).

Recently, it is demanded to further enhance operability of a replacing operation of a toner cartridge.

SUMMARY OF THE INVENTION

The present invention is intended to provide a developer storing body, an image forming unit and an image forming apparatus capable of enhancing operability of a replacing operation of the developer storing body.

The present invention provides a developer storing body detachably attached to an image forming unit main body of an image forming unit. The developer storing body includes a cartridge main body for storing a developer. The cartridge main body has a developer outlet opening through which the developer is ejected. The developer storing body includes an outlet shutter member movable with respect to the cartridge main body so as to open and close the developer outlet opening. A movable direction of the outlet shutter member is substantially the same as a direction in which the developer storing body is attached to and detached from the image forming unit main body.

Since the outlet shutter member is movable in a direction substantially the same as the direction in which the developer storing body is attached to and detached from the image forming unit main body, an operator can intuitively handle the developer storing body with few motions. Therefore, operability of the replacing operation of the developer storing body is enhanced.

The present invention also provides a developer storing body including a cartridge main body for storing a developer. The cartridge main body has a developer outlet opening through which the developer is ejected. The developer storing body further includes an outlet shutter member movable with respect to the cartridge main body. The outlet shutter is moved by an operation of an operating portion. The cartridge main body has a protrusion that protrudes in a predetermined direction. The outlet shutter member is movable in a direction substantially parallel to the predetermined direction in which the protrusion protrudes.

The present invention also provides an image forming unit including the above described developer storing body and an image forming unit main body to which the developer storing body is detachably attached. The image forming unit main body includes a developing process cartridge having a developer inlet opening for receiving the developer ejected from the developer storing body, and an inlet shutter member for opening and closing the developer inlet opening. The developing process cartridge has a to-be-locked portion brought into engagement with a locking portion of the developer storing body. The inlet shutter member is movable in conjunction with the outlet shutter member of the developer storing body.

The present invention also provides an image forming apparatus to which the above described image forming unit is mounted.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the attached drawings. Descriptions will be made of a printer as an example of an image forming apparatus.

Figure 1:
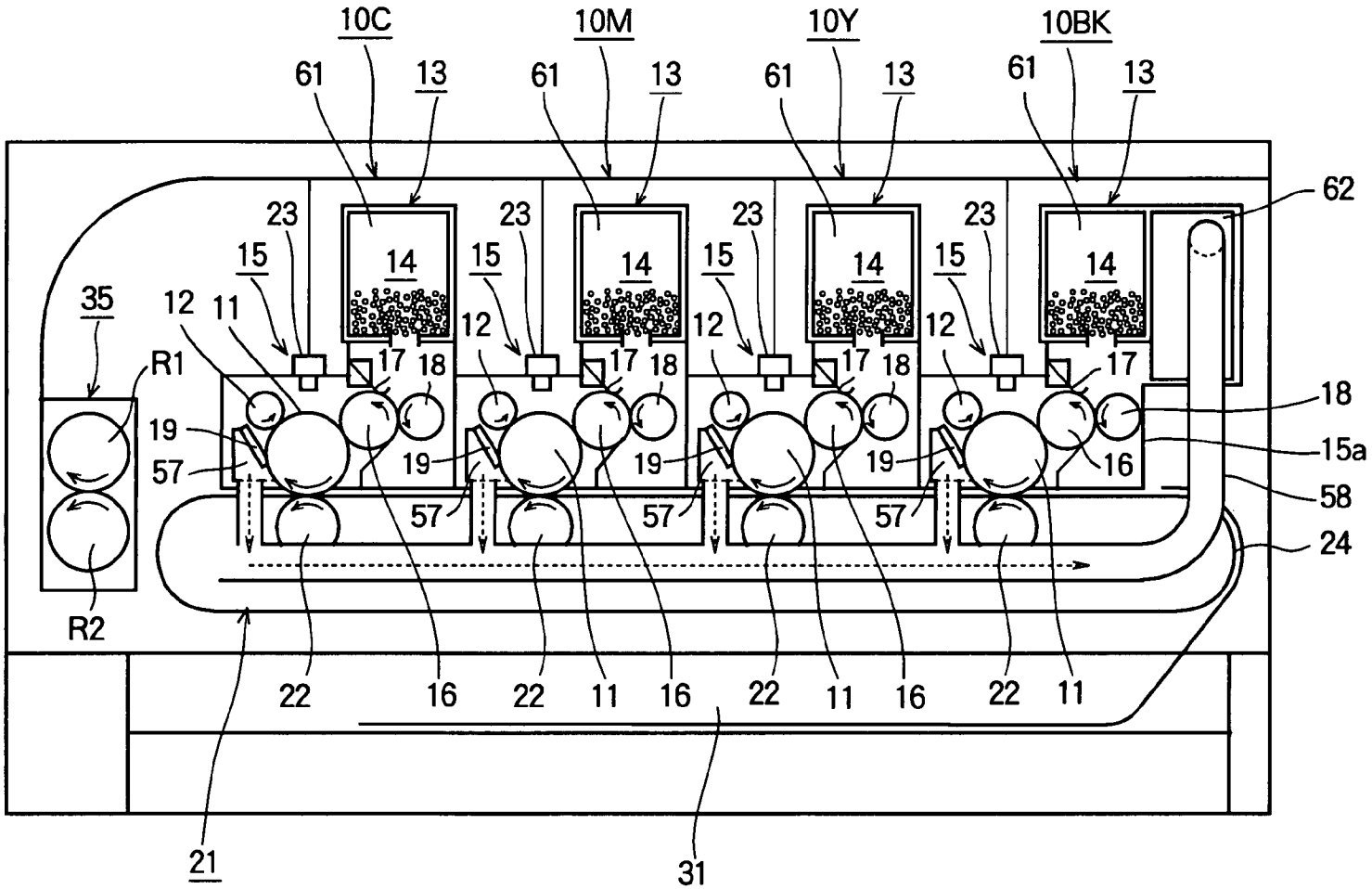
FIG. 1 is a schematic view showing a printer as an image forming apparatus according to the first embodiment of the present invention.

FIG. 1 is a schematic view showing a printer (i.e., an image forming apparatus) according to the first embodiment of the present invention. In FIG. 1, the printer includes image forming portions 10Bk, 10Y, 10M and 10C that respectively form images using toners 14 (i.e., developers) of black, yellow, magenta and cyan, and a transfer unit 21 (i.e., a transfer portion) provided along the image forming portions 10Bk, 10Y, 10M and 10C. The image forming portions 10Bk, 10Y, 10M and 10C respectively include image forming units 15 and LED heads 23 (i.e., exposure devices) provided corresponding to the image forming units 15.

A sheet cassette 31 (i.e., a medium storing portion) is provided below the transfer unit 21. Sheets (i.e., media) are stacked in the sheet cassette 31. The individual sheet is fed out of the sheet cassette 31, and is fed through between the respective image forming portions 10Bk, 10Y, 10M and 10C and the transfer unit 21.

Each image forming unit 15 includes an image forming unit main body 15*a* and a toner cartridge 13 (i.e., a developer storing body) detachably attached to the image forming unit main body 15*a*. The toner cartridge 13 includes a toner storing portion 61 (i.e., a developer storing portion) for storing the toner 14.

In the image forming unit main body 15*a*, a photosensitive drum 11 is provided. The photosensitive drum 11 is in the form of a drum, and has a surface layer formed of an organic photosensitive body. The photosensitive drum 11 is also referred to as an image bearing body that bears an electrostatic latent image (i.e., a latent image). Around the photosensitive drum 11, a charging roller 12 (i.e., a charging device), a developing roller 16 (i.e., a developer bearing body), a developing blade 17 (i.e., a developer regulating member), a toner supplying roller 18 (i.e., a developer supplying member) and a cleaning blade 19 (i.e., a cleaning member) are arranged. The charging roller 12 is provided contacting the photosensitive drum 11 and uniformly charges the surface of the photosensitive drum 11. The developing roller 16 develops the latent image on the surface of the photosensitive drum 11 to form a toner image (i.e., a developer image). The developing blade 17 regulates a thickness of a toner layer on the surface of the developing roller 16. The toner supplying roller 18 supplies the toner (supplied by the toner cartridge 13) to the developing roller 16. The developing roller 16, the developing blade 17, the toner supplying roller 18 and the like constitute a developing unit.

In this embodiment, a rotation of a not shown driving motor (i.e., a driving portion) is transmitted to the photosensitive drum 11, the charging roller 12, the developing roller 16 and the toner supplying roller 18 via not shown gears. The photosensitive drum 11 rotates at a constant circumferential speed. Further, the charging roller 12, the developing roller 16, the toner supplying roller 18 and the like rotate in respective directions as indicated by arrows in FIG. 1.

In the image forming unit 15, the surface of the photosensitive drum 11 is uniformly charged by the charging roller 12, and is exposed by the LED head 23 so that the latent image is formed on, the surface of the photosensitive drum 11. The latent image is developed with the toner 14 by the developing roller 16, and the toner image is formed on the surface of the photosensitive drum 11.

The transfer unit 21 includes a transfer belt 24 (i.e., a belt member) stretched around not shown rollers. The transfer belt 24 is movable so as to contact the respective photosensitive drums 11 of the image forming portions 10Bk, 10Y, 10M and 10C. The transfer unit 21 further includes transfer rollers 22 provided so as to face the photosensitive drums 11 via the transfer belt 24. The transfer rollers 22 transfer the toner images on the respective photosensitive drums 11 to the sheet (having been fed from the sheet cassette 31) fed by the transfer belt 24, so that a color toner image is formed on the sheet.

The toner 14 remaining on the surface of the photosensitive drum 11 (after the transferring of the toner image) is scraped off from the surface of the photosensitive drum 11 by the cleaning blade 19.

A fixing unit 35 (i.e., a fixing device) is provided on a downstream side of the image forming portions 10Bk, 10Y, 10M and 10C along a sheet feeding path. The fixing unit 35 includes a fixing roller R1 as a first roller and a pressure roller R2 as a second roller, and is configured to fix the color toner image to the sheet (having been fed from the image forming portions 10Bk, 10Y, 10M and 10C). The sheet with the color image is ejected out of a main body of the printer.

The photosensitive drums 11, the charging rollers 12, the LED heads 23, the developing rollers 16, the toner supplying rollers 18, the transfer rollers 22 and the fixing unit 35 are controlled by a not shown control unit. The control unit applies direct voltages to the charging rollers 12, the transfer rollers 22, the developing rollers 16 and the toner supplying rollers 18 at predetermined timings, and drives the driving motor so as to rotate the photosensitive drums 11, the charging rollers 12, the developing rollers 16, the toner supplying rollers 18 and the fixing roller R1 respectively in the directions indicated by arrows.

First conveying units 57 are provided corresponding to the respective photosensitive drums 11, and convey the toner 14 (having been scraped off by the cleaning blades 19) as a waste toner in the axial direction of the photosensitive drums 11. A second conveying unit 58 collects the waste toner conveyed by the respective first conveying units 57, and conveys the waste toner to a waste toner storing portion 62 (i.e., a waste developer storing container) provided at an upstream end of the image forming portions 10Bk, 10Y, 10M and 10C along the sheet feeding path. The waste toner storing portion 62 stores the waste toner conveyed by the second conveying unit 58.

The toner cartridges 13, the image forming units 15, the waste toner storing portion 62 and the like are respectively formed as replaceable units each of which can be replaced when he toner 14 is used up or when lifetime expires i.e., when the component is deteriorated).

Next, a description will be made of a casing 80 in which the image forming units 15 of the respective colors are housed.

Figure 2:
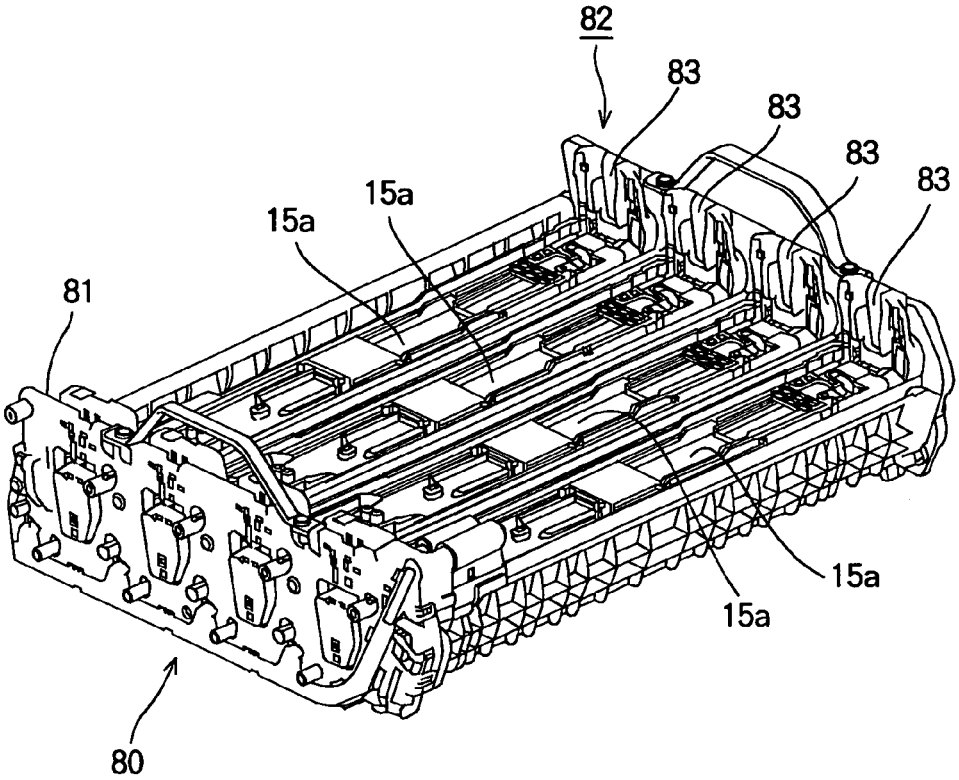
FIG. 2 is a perspective view showing a casing in which an image forming unit according to the first embodiment of the present invention is housed.

FIG. 2 is a perspective view showing the casing 80 in which the image forming units 15 according to the first embodiment of the present invention are housed.

FIG. 2 is a perspective view showing the casing in which the image forming units 15 according to the first embodiment of the present invention are housed.

In FIG. 2, the respective image forming units 15 are housed in the casing 80. The image forming unit main bodies 15*a* are arranged at constant pitches in the casing 80, and the toner cartridges 13 (not shown in FIG. 2) are detachably attached to the image forming unit main bodies 15*a*.

Both sides of each image forming unit main body 15*a* are fixed to first and second side frames 81 and 82. Guide grooves 83 are formed on an inner side of the second side frame 82. The guide grooves 83 are configured to guide the toner cartridges 13 when the toner cartridges 13 are attached to the image forming unit main bodies 15*a*.

Each image forming unit main body 15*a* includes an image bearing body housing portion (i.e., a first part) and a developing unit housing portion 20 (i.e., a second part). The image bearing body housing portion houses the photosensitive drum 11, the charging roller 12, the cleaning roller 19 and the like. The developing unit housing portion 20 houses the developing unit. The toner cartridge 13 is attached to the developing unit housing portion 20.

Next, a description will be made of the developing unit housing portion 20.

Figure 3:
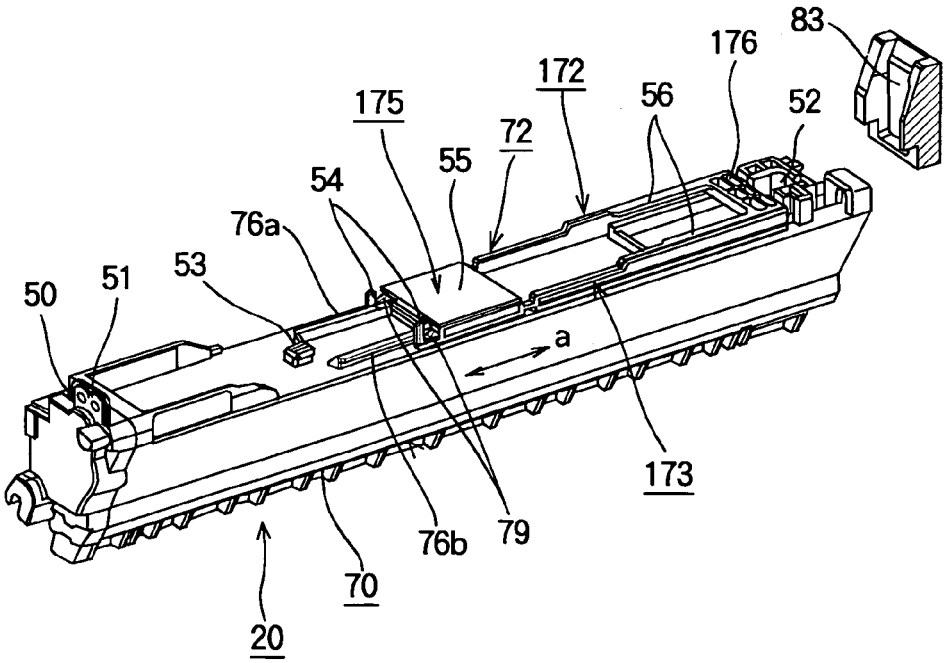
FIG. 3 is a perspective view showing a developer storing portion according to the first embodiment of the present invention.
Figure 4:
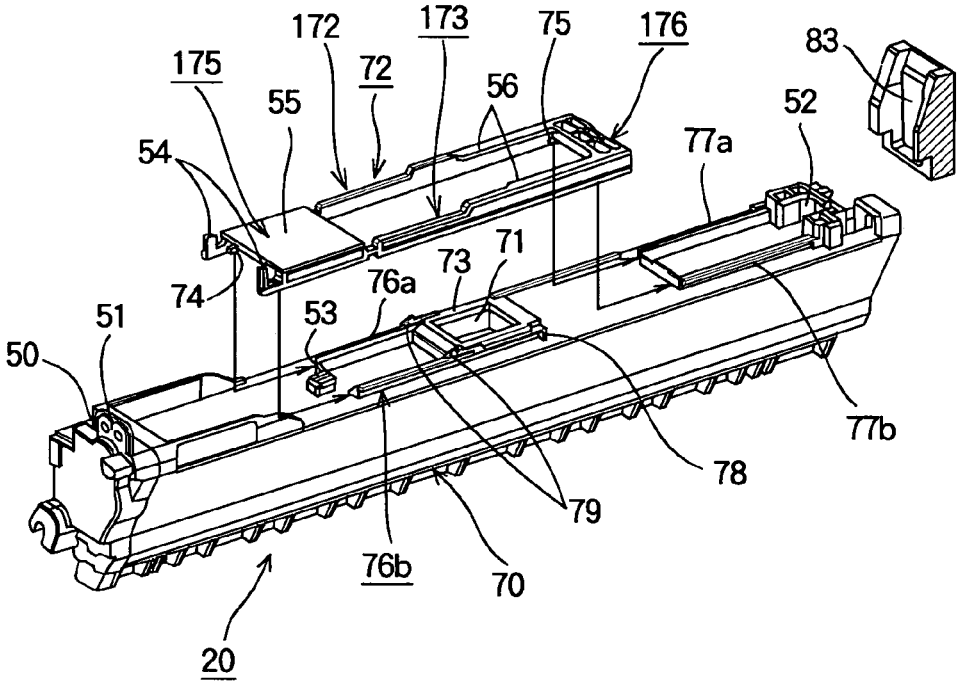
FIG. 4 is an exploded perspective view showing the developer storing portion according to the first embodiment.

FIGS. 3 and 4 are a perspective view and an exploded perspective view showing the developing unit housing portion 20 according to the first embodiment of the present invention. In this regard, the guide groove 83 formed on the inner side of the second side frame 82 (FIG. 2) is also shown in FIGS. 3 and 4 for convenience of explanation.

In FIGS. 3 and 4, the developing unit housing portion 20 includes a developing process cartridge 70, an inlet shutter member 72 and an inlet seal member 73.

The developing process cartridge 70 houses the above described developing unit therein. A toner inlet opening as a developer inlet opening is formed at a substantially center part of a top of the developing process cartridge 70. A driving gear 50 as a first rotation transmitting body is provided at an end of the developing process cartridge 70. The driving gear 50 is provided for transmitting a rotation to an agitation member (described later) in the toner cartridge 13.

A first positioning portion 51 is formed on an end of the developing process cartridge 70 for determining a position of the toner cartridge 13 in a height direction, a longitudinal direction and a widthwise direction. A second positioning portion 52 is formed on the other end of the developing process cartridge 70 for determining a position of the toner cartridge 13 in the longitudinal direction and the widthwise direction. Further, first and second locking portions 53 and 56 are formed on the developing process cartridge 70 for locking the toner cartridge 13 with respect to the developing process cartridge 70.

The inlet shutter member 72 has a frame-like shape, and includes frame portions 172 and 173 extending parallel to each other in the longitudinal direction of the developing process cartridge 70, connection members 175 and 176 that connect both ends of the frame portions 172 and 173. The inlet shutter member 72 is detachably attached to the developing process cartridge 70. The inlet shutter member 72 is movable in a longitudinal direction of the developing process cartridge 70 as indicated by an arrow "a" in FIG. 3 so as to open and close the toner inlet opening 71.

The developing process cartridge 70 has a pair of first guide rails 76*a* and 76*b* disposed at a first portion in the longitudinal direction, and the first guide rails 76*a* and 76*b* extend parallel to each other. The developing process cartridge 70 further has a pair of second guide rails 77*a* and 77*b* disposed at a second portion in the longitudinal direction apart from the first position by a predetermined distance, and the second guide rails 77*a* and 77*b* extend parallel to each other. The inlet shutter member 72 has a pair of first to-be-guided rails 74 each provided on an end of the respective frame members 172 and 173 so as to correspond to the first guide rails 76*a* and 76*b*. The first to-be-guided rails 74 extend in the longitudinal direction of the first guide rails 76*a* and 76*b*. In this regard, only one of the first to-be-guided rails 74 (provided on the frame member 172) is shown in FIG. 4. The inlet shutter member 72 has a pair of second to-be-guided rails 75 provided on the other ends of the frame members 172 and 173 so as to correspond to the second guide rails 77*a* and 77*b*. The second to-be-guided rails 75 extend in the longitudinal direction of the second guide rails 77*a* and 77*b*. In this regard, only one of the second to-be-guided rails 75 (provided on the frame member 172) is shown in FIG, 4, The above described first guide rails 76*a* and 76*b* are formed so as to sandwich the inlet shutter member 72 therebetween.

The first guide rails 76*a* and 76*b* respectively engage the first to-be-guided rails 74, and the second guide rails 77*a* and 77*b* respectively engage the second to-be-guided rails 75, so that the inlet shutter member 72 is slidable (movable) on the developing process cartridge 70 in the direction indicated by the arrow "a" in FIG. 3.

Further, the inlet seal member 73 is fixed to the developing process cartridge 70 by means of adhesion so as to surround the toner inlet opening 71. The inlet seal member 73 is compressed between the toner inlet opening 71 and the inlet shutter member 72, and seals between the toner inlet opening 71 and the inlet shutter member 72. For this purpose, a low-friction coating is formed on a sliding surface (pressed against the inlet shutter member 72) of the inlet seal member 73. In other words, the sliding surface of the inlet seal member 73 is subjected to low-friction treatment, so as not to apply a large load to the inlet shutter member 72 when the inlet shutter member 72 is moved.

The developing unit housing portion 20 is so configured as to prevent the toner inlet opening 71 from being opened when the inlet shutter member 72 is erroneously operated to move from a closing position (i.e., a position to close the toner inlet opening 71) in a state where the toner cartridge 13 is not attached to the developing unit housing portion 20 (i.e., not attached to the image forming unit main body 15*a*). Zone Name: a8,AMD For this purpose, a first regulating portion 78 is provided on an end of the first guide rail 76*a*, and a further first regulating portion 78 is provided on an end of the first guide rail 76*b*. A second regulating portion 79 having snap-fit features is provided another end of the first guide rail 76*a*, and a further second regulating portion 79 is provided on another end of the first guide rail 76*b*. The first and second regulating portions 78 and 79 respectively engage corresponding portions of the inlet shutter member 72.

In this regard, the toner cartridge 13 has an outlet shutter member 91 (FIG. 5) as described later. The outlet shutter member 91 is moved so as to open and close a toner outlet opening 98 (FIG. 7) as described later. The movement of the outlet shutter member 91 is regulated (prevented) in a state where the toner cartridge 13 is not attached to the developing unit housing portion 20.

For this purpose, the inlet shutter member 72 has outlet shutter regulation releasing portions 54 formed on one end of the frame members 172 and 173. The outlet shutter regulation releasing portions 54 press second regulating portions 46 (described later) of the toner cartridge 13 to release the regulation of the movement of the outlet shutter member 91 when the toner cartridge 13 is attached to the developing unit housing portion 20.

The inlet shutter member 72 has a to-be-coupled portion 55 provided on the frame members 172 and 173. In the state where the toner cartridge 13 is attached to the developing unit housing portion 20, the to-be-coupled portion 55 causes the inlet shutter member 72 to move in conjunction with the outlet shutter member 91 according to the movement of the outlet shutter member 91.

In this regard, when the inlet shutter member 72 is moved toward an opening position (i.e., a position to open the toner inlet opening 71), the second locking portions 56 lock the toner cartridge 13 with respect to the developing unit housing portion 20.

Next, a description will be made of the toner cartridge 13.

Figure 5:
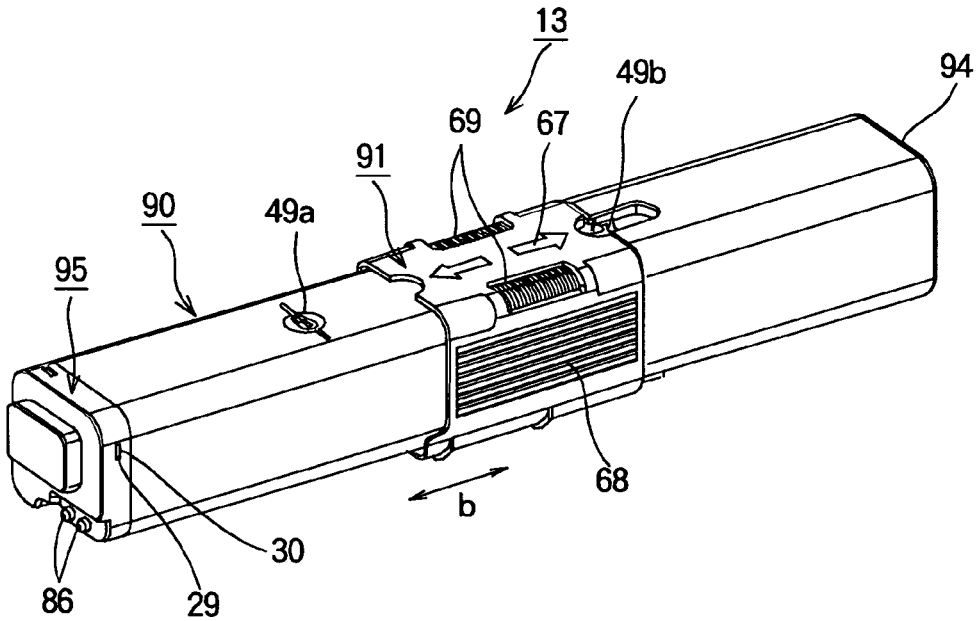
FIG. 5 is a perspective view showing a toner cartridge according to the first embodiment of the present invention.
Figure 6:
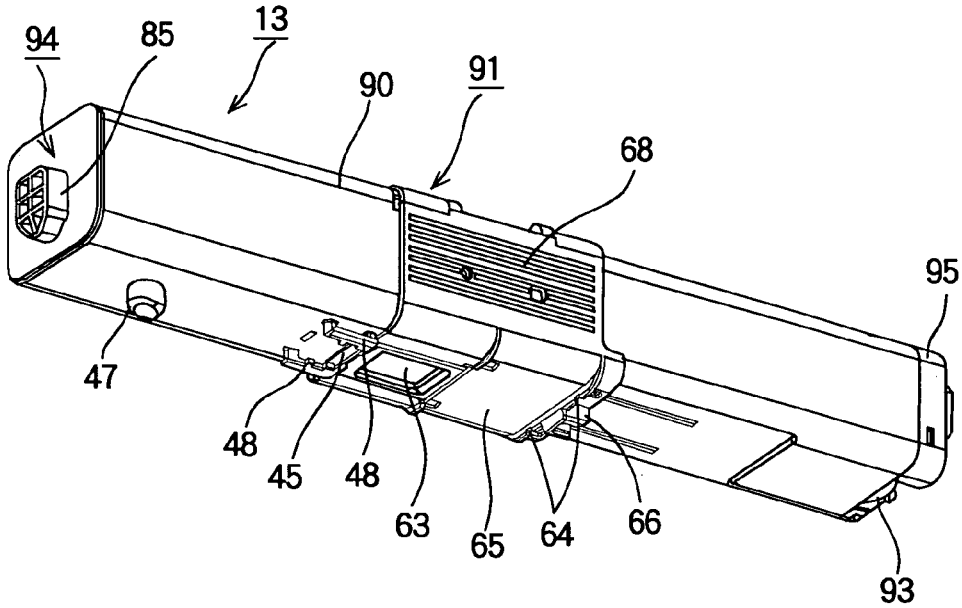
FIG. 6 is another perspective view showing the toner cartridge according to the first embodiment of the present invention.
Figure 7:
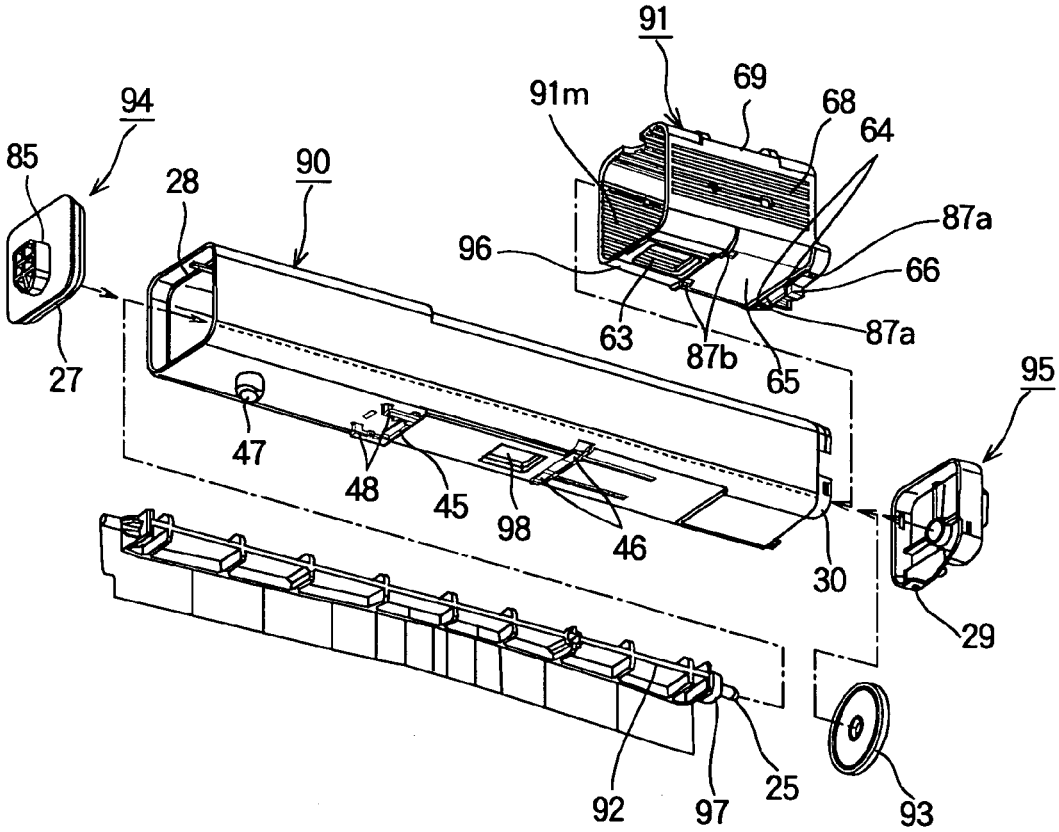
FIG. 7 is an exploded perspective view showing the toner cartridge according to the first embodiment of the present invention.
Figure 8:
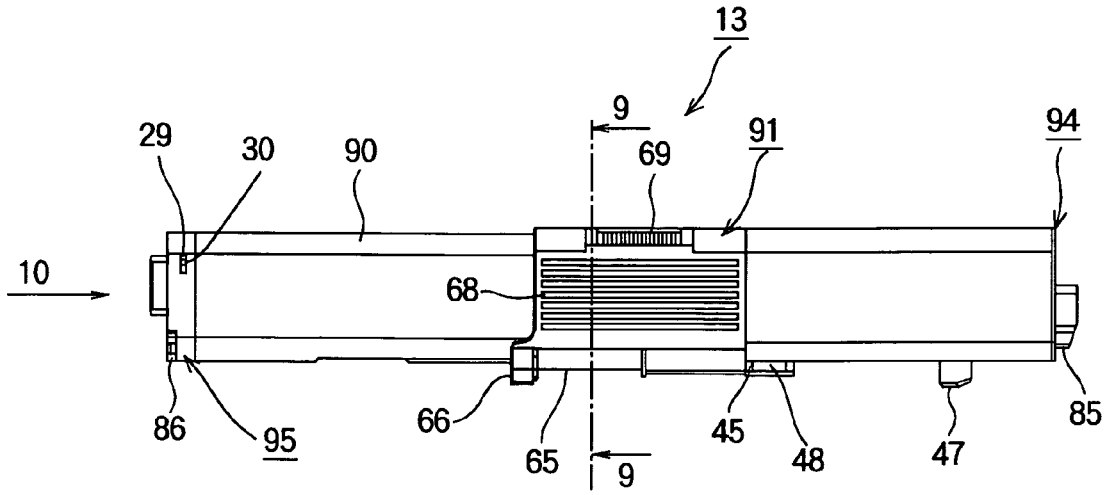
FIG. 8 is a front view showing the toner cartridge according to the first embodiment of the present invention.
Figure 9:
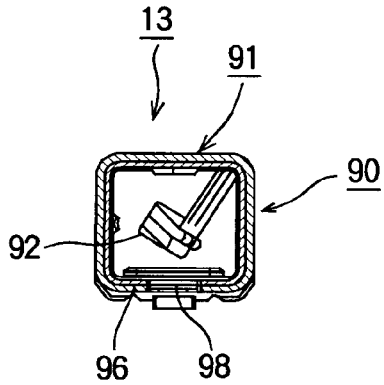
FIG. 9 is a sectional view taken along line 9-9 in FIG. 8.
Figure 10:
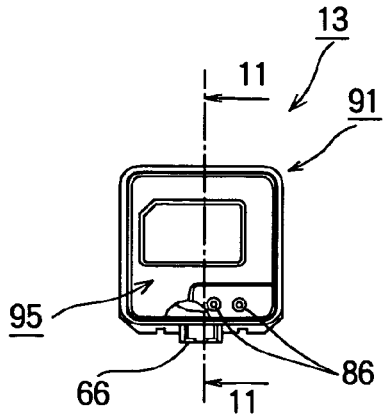
FIG. 10 is a side view of the toner cartridge according to the first embodiment of the present invention as seen from a direction shown by an arrow 10 in FIG. 8.
Figure 11:
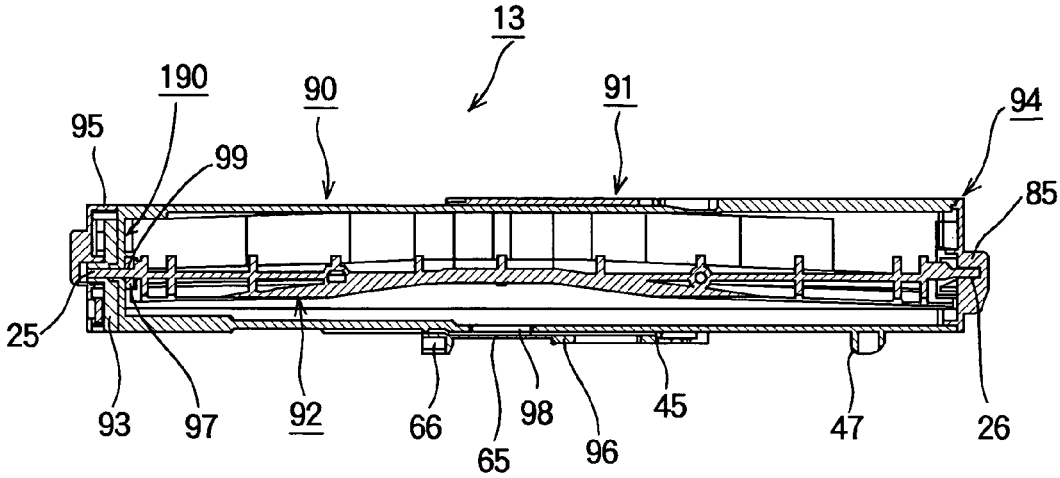
FIG. 11 is a sectional view taken along line 11-11 in FIG. 10.

FIGS. 5 and 6 are first and second perspective views showing the toner cartridge 13 according to the first embodiment of the present invention as seen from different directions. FIGS. 7 and 8 are an exploded perspective view and a front view showing the toner cartridge 13 according to the first embodiment of the present invention. FIG. 9 is a sectional view taken along line 9-9 in FIG. 8. FIG. 10 is a side view as seen from a direction shown by an arrow 10 in FIG. 8. FIG. 11 is a sectional view taken along line 11-11 in FIG. 10.

As shown in FIGS. 5, 6 and 7, the toner cartridge 13 includes a cartridge main body 90, the outlet shutter member 91, an agitation member 92, an agitation driving gear 93 (as a second transmitting body for rotating the agitation member 92), a lid member 94, a cover member 95, an outlet seal member 96 and an agitation seal member 97.

The cartridge main body 90 is in the form of a rectangular tube having a substantially rectangular cross section and having a bottom. An end (i.e., a first end) of the cartridge main body 90 is closed, and the other end (i.e., a second end) of the cartridge main body 90 is opened. The lid member 94 is fixed to the opened end (i.e., the second end) of the cartridge main body 90 by means of welding or the like, so as to seal the cartridge main body 90 and to form a space for storing the toner 14. The cartridge main body 90 has the toner outlet opening 98 as a developer outlet opening formed at a substantially center part (in a longitudinal direction) of a bottom of the cartridge main body 90. The cartridge main body 90 has an end plate 190 (FIG. 11) at the closed end (i.e., the first end) to which the cover member 95 is mounted. An agitation shaft hole 99 (FIG. 11) as a through hole is formed on the end plate 190. First operation indicators 49*a* and 49*b* (FIG. 5) are provided on the upper surface of the cartridge main body 90 based on which an operator visually recognizes a position of the outlet shutter member 91.

The outlet shutter member 91 is provided so as to surround the cartridge main body 90, and is movable (slidable) in the longitudinal direction of the cartridge main body 90 as indicated by an arrow "b" in FIG. 5 so as to open and close the toner outlet opening 98. For this purpose, the outlet shutter member 91 has an opening 63 (FIG. 6) that leads to the toner outlet opening 98 when the outlet shutter member 91 is in an opening position.

The outlet shutter member 91 has a second operation indicator 67 based on which the operator visually recognizes a position of the outlet shutter member 91. Further, the outlet shutter member 91 has a grip portion 68 at which the operator holds the cartridge main body 90, and an operating portion 69 to which the operator applies a force in a moving direction of the outlet shutter member 91 while distributing the force downwardly. The provision of the operating portion 69 facilitates the movement of the toner cartridge 13. A plurality of grooves 91m are formed on an inner surface of the outlet shutter member 91. The provision of the grooves 91m reduces a contact area between the cartridge main body 90 and the outlet shutter member 91, and therefore a large torque is not applied to the outlet shutter member 91 when the outlet shutter member 91 is moved.

As shown in FIG. 11, the agitation member 92 is provided in the cartridge main body 90 and is rotatably supported by the end plate 190 and the lid member 94. The agitation member 92 rotates and agitates the toner 14 in the cartridge main body 90 so as to eject a stable amount of the toner 14 via the toner outlet opening 98. For this purpose, a gear connecting portion 25 (with a latch engagement groove and a D-cut portion) is formed on an end of the agitation member 92. The gear connecting portion 25 penetrates the agitation shaft hole 99 of the end plate 190, and engages the agitation driving gear 93 (inside the cover member 95) by means of latching engagement. The lid member 94 has an agitation shaft groove 26 at an inner side surface thereof.

The agitation member 92 is rotated by the rotation of the agitation driving gear 93, and the agitation member is prevented from being dropped out of the agitation driving gear 93. The gear connecting portion 25 and the agitation driving gear 93 constitute a rotation transmitting portion.

As shown in FIG. 7, in order to determine the position of the agitation member 92 with respect to the cartridge main body 90, a positioning fitting portion 27 (i.e., a positioning member) is formed inside and along a circumference of the lid member 94. The positioning fitting portion 27 engages a positioning groove 28 (i.e., a positioning member) formed on an inner side of the cartridge main body 90. Further, latch engagement holes 29 (i.e., engaging portions) are formed on a circumference of the cover member 95. The latch engagement holes 29 engage latch engagement portions 30 (i.e., engaging portions) formed on the cartridge main body 90.

The outlet seal member 96 is compressed between the toner outlet opening 98 and the outlet shutter member 91, and seals between the toner outlet opening 98 and the outlet shutter member 91. For this purpose, a low-friction coating is formed on a sliding surface (pressed against the cartridge main body 90) of the outlet seal member 96. In other words, the sliding surface of the outlet seal member 96 is subjected to low-friction treatment, so as not to apply a large load to the outlet shutter member 91 when the outlet shutter member 91 is moved.

The agitation seal member 97 seals the agitation shaft hole 99 in a compressed state. For this purpose, a low-friction coating is formed on sliding surfaces of the agitation seal member 97 pressed against the agitation member 92 and the end plate 190. In other words, the sliding surfaces of the agitation seal member 97 are subjected to low-friction treatment, so as not to apply a large load to the agitation seal member 97 when the agitation member 92 is rotated.

The cartridge main body 90 has first and second regulating portions 45 and 46 formed on the bottom of the cartridge main body 90. The first and second regulating portions 45 and 46 contact the outlet shutter member 91 to thereby regulate the movement of the outlet shutter member 91. Further, position regulating holes 87*a* and 87*b* (i.e., position regulating portions) are formed on the bottom of the outlet shutter member 91. The position regulating holes 87*a* and 87*b* engage the second regulating portions 46 of the cartridge main body 90 so as to prevent the movement of the outlet shutter member 91 from the closing position or the opening position.

The lid member 94 has a guide rib 85 (FIG. 7) guided by the guide groove 83 of the second side frame 82 (FIG. 2). The cover member 95 has first to-be-positioned portions 86 (i.e., positioning pins) as protrusions as shown in FIG. 10 (also shown in FIG. 12). The first to-be-positioned portions 86 protrude in a predetermined direction. Particularly, in this embodiment, the first to-be-positioned portions 86 protrude in a direction in which the outlet shutter member 91 is movable. The first to-be-positioned portions 86 engage holes of the first positioning portion 51 of the developing process cartridge (FIG. 4), and determine the position of the toner cartridge 13 in the height direction and in the widthwise direction.

The outlet shutter member 91 has inlet shutter regulation releasing portions 64 (FIG. 7) that press the second regulating portions 79 to release the regulation of the movement of the inlet shutter member 72. The outlet shutter member 91 further has a coupling portion 65 that causes the inlet shutter member 72 to move together with the outlet shutter member 91, and a first to-be-locked portion 66 (FIGS. 6-8, 10) brought into engagement with the first locking portion 53 (FIG. 4).

The cartridge main body 90 includes a second to-be-positioned portion 47 that engages the second positioning portion 52 (FIG. 4) of the developing process cartridge 70 and determines the position of the toner cartridge 13 in the longitudinal direction and in the widthwise direction. The cartridge main body 90 further has second to-be-locked portions 48 (FIG. 7) which are brought into engagement with the second locking portions 56 (FIG. 4) of the inlet shutter member 72 when the outlet shutter member 91 moves toward the opening position. The second to-be-locked portions 48 protrude in a direction substantially the same as the movable direction of the outlet shutter member 91.

Next, a description will be made of an attaching and detaching operation of the toner cartridge 13 with respect to the image forming unit main body 15*a* according to the first embodiment of the present invention.

Figure 16:
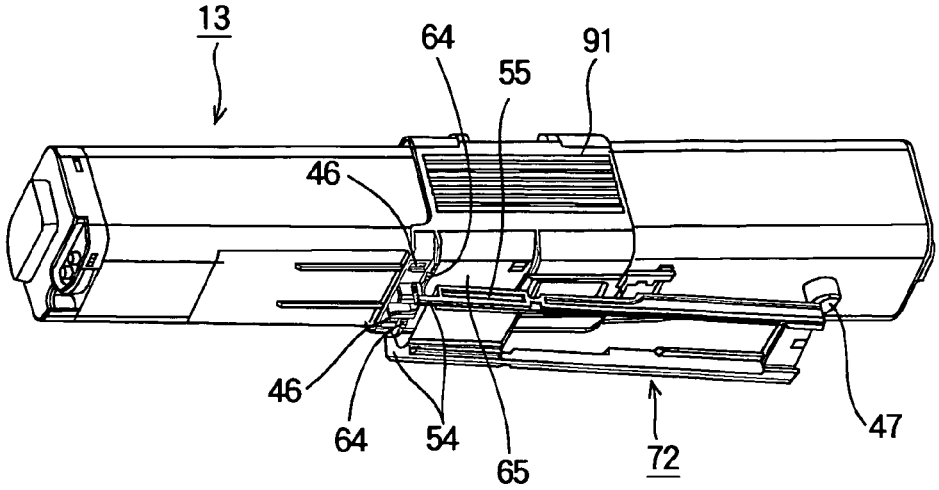
FIG. 16 is a first perspective view showing an inlet shutter member during the attaching and detaching operation of the toner cartridge with respect to the image forming unit main body according to the first embodiment of the present invention.
Figure 17:
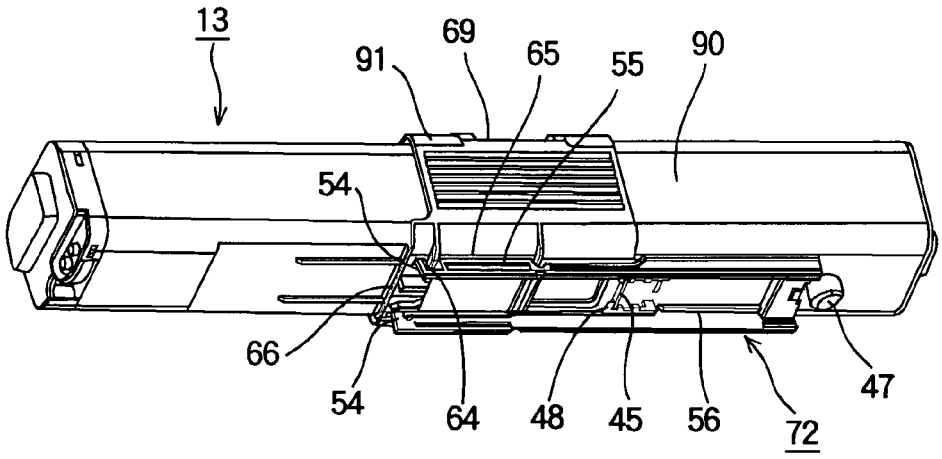
FIG. 17 is a second perspective view showing the inlet shutter member during the attaching and detaching operation of the toner cartridge with respect to the image forming unit main body according to the first embodiment.
Figure 18:
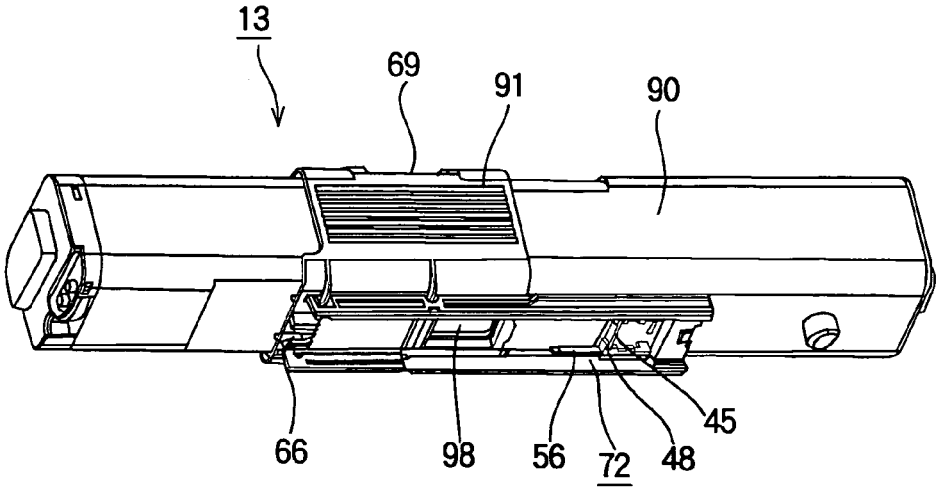
FIG. 18 is a third perspective view showing the inlet shutter member during the attaching and detaching operation of the toner cartridge with respect to the image forming unit main body according to the first embodiment.

FIGS. 12, 13, 14 and 15 are perspective views showing the attaching and detaching operation of the toner cartridge 13 with respect to the image forming unit main body 15*a* according to the first embodiment of the present invention. FIGS. 16, 17 and 18 are perspective views showing the inlet shutter member 72 (together with the toner cartridge 13) during the attaching and detaching operation of the toner cartridge 13 with respect to the image forming unit main body 15*a*. In FIGS. 12 through 18, the guide groove 83 formed on the inner side of the second side frame 82 (FIG. 2) is also shown for convenience of explanation.

First, the attaching operation of the toner cartridge 13 to the image forming unit main body 15*a* will be described.

Figure 12:
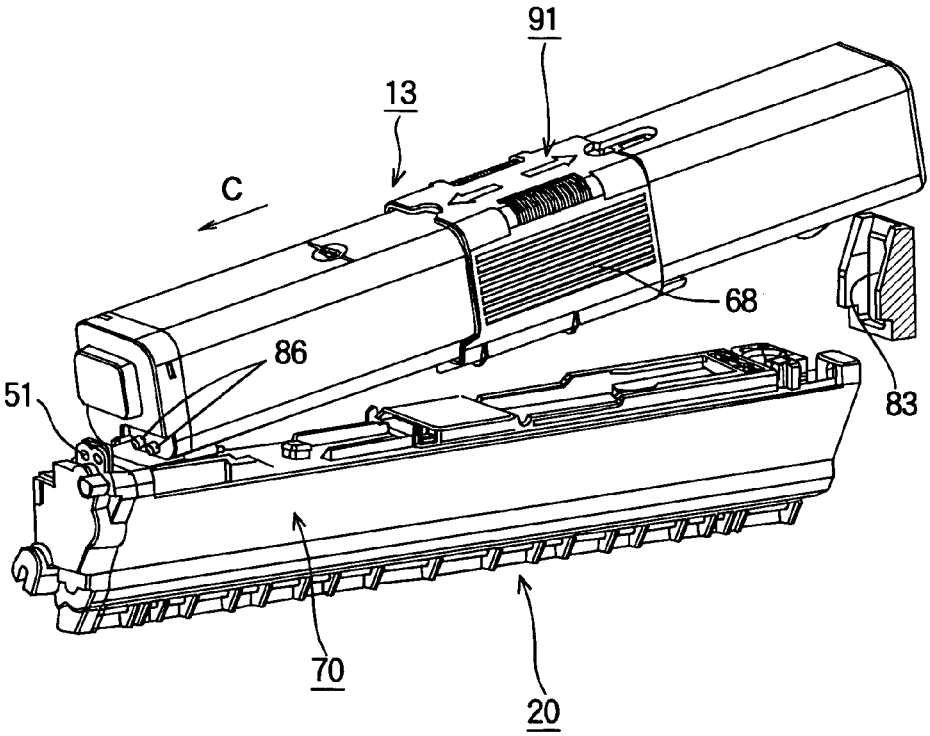
FIG. 12 is a first perspective view for illustrating an attaching and detaching operation of the toner cartridge with respect to an image forming unit main body according to the first embodiment of the present invention.

In order to attach the toner cartridge 13 to the image forming unit main body 15*a*, the operator holds the grip portion 68 of the outlet shutter member 91, and moves the toner cartridge 13 in a direction indicated by an arrow "C" in FIG. 12 so that the first to- be-positioned portions 86 (i.e., the protrusions) engage the first positioning portion 51 of the developing process cartridge 70.

Figure 13:
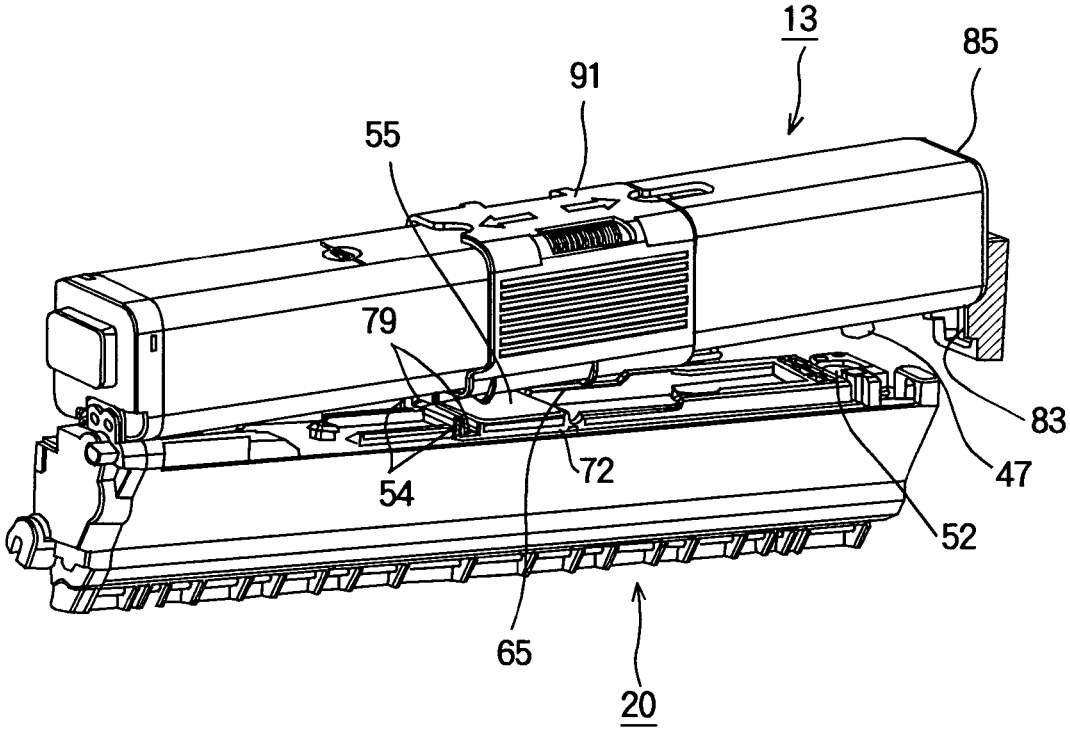
FIG. 13 is a second perspective view for 1 rating the attaching and detaching operation of the toner cartridge with respect to the image forming unit main body according to the first embodiment of the present invention.
Figure 14:
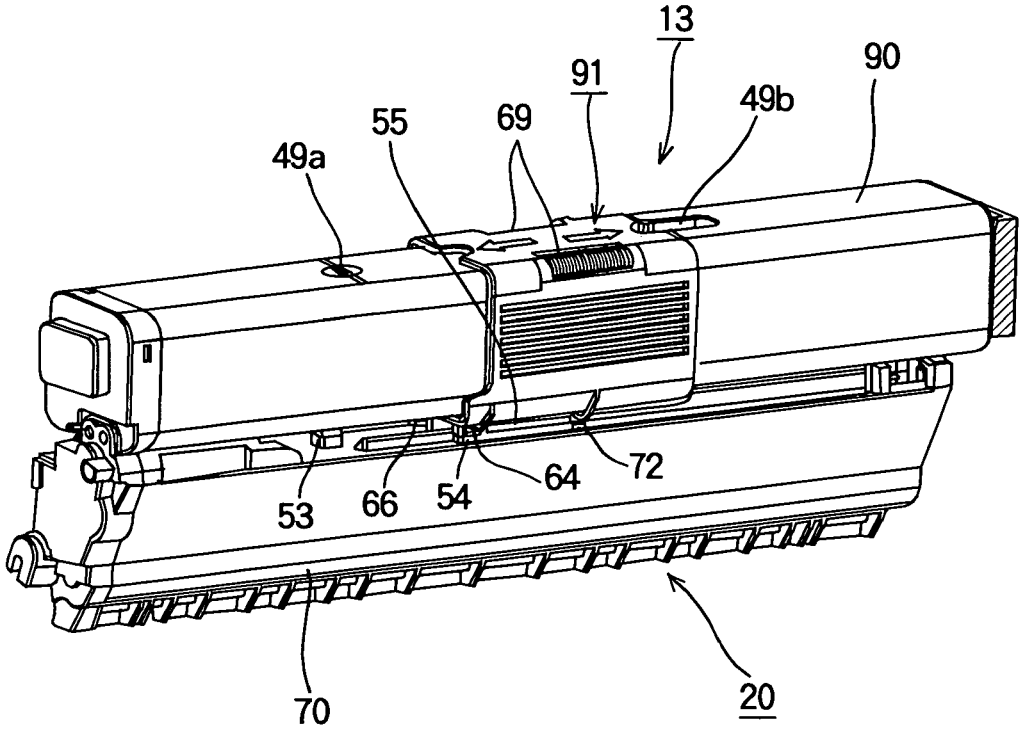
FIG. 14 is a third perspective view for illustrating the attaching and detaching operation of the toner cartridge with respect to the image forming unit main body according to the first embodiment of the present invention.

Then, the operator inserts the guide rib 85 (FIG. 7) of the toner cartridge 13 into the guide groove 83 of the second side frame 82 as shown in FIG. 13, and moves the guide rib 85 downward along the guide groove 83, so that the toner cartridge 13 is placed parallel on the developing process cartridge 70 as shown in FIG. 14. In this state, the movable direction of the outlet shutter member 91 coincides with the longitudinal direction of the toner cartridge 13.

In this state, the second to-be-positioned portion (FIG. 17) of the toner cartridge 13 engages the second positioning portion 52 (FIG. 4) of the developing process cartridge 70, and the coupling portion 65 (FIG. 17) of the toner cartridge 13 engages the to-be-coupled portion 55 (FIG. 4) of the developing process cartridge 70. Further, the outlet shutter regulation releasing portions 54 (FIG. 4) of the inlet shutter member 72 press the second regulating portions 46 (FIG. 16) of the toner cartridge 13, and the inlet shutter regulation releasing portions 64 (FIG. 17) of the toner cartridge 13 press the second regulating portions 79 (FIG. 4) of the developing process cartridge 70. Therefore, the second regulating portions 46 of the toner cartridge 13 and the second regulating portions 79 of the developing process cartridge 70 are displaced, so as to release the regulations of movements of the outlet shutter member 91 and the inlet shutter member 72 toward the respective opening positions.

Figure 15:
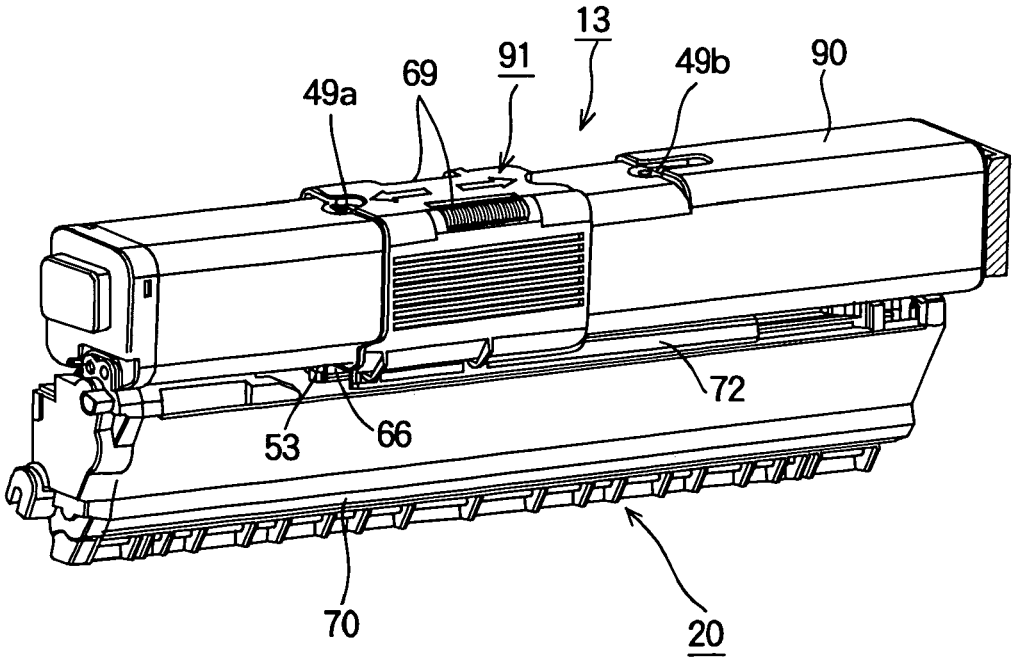
FIG. 15 is a fourth perspective view for illustrating the attaching and detaching operation of the toner cartridge with respect to the image forming unit main body according to the first embodiment of the present invention.

Then, the operator pushes the operating portion 69 of the outlet shutter member 91 to move the outlet shutter member 91 toward the opening position as shown in FIG. 15. According to the movement of the outlet shutter member 91, the inlet shutter member 72 also moves toward the opening position as shown in FIG. 18. At the same time, the second locking portions 56 of the inlet shutter member 72 start engaging the second to-be-locked portions 48 of the cartridge main body 90, and therefore the toner cartridge 13 is prevented from being detached from the image forming unit main body 15*a*. Further, the movable direction of the outlet shutter member 91 coincides with a direction in which the second locking portions 56 engage the second to-be-locked portions 48.

When the outlet shutter member 91 reaches the opening position, the operator recognizes that the outlet shutter member 91 reaches the opening position based on the first operation indicator 49*a*. In this state, the outlet shutter member 91 and the inlet shutter member 72 fully open the toner outlet opening 98 and the toner inlet opening 71 (FIG. 4) so that the toner outlet opening 98 leads to the toner inlet opening 71. As shown in FIG. 15, the first locking portion 53 of the developing process cartridge 70 engages the first to-be-locked portion 66 of the outlet shutter member 91, so that the developing process cartridge 70 and the outlet shutter member 91 engage each other on both of the toner outlet opening 98 side and the toner inlet opening 71 side. In this state, the position regulating holes 87*b* (FIG. 7) of the outlet shutter member 91 engage the second regulating portions 46 (FIG. 7) of the cartridge main body 90, and therefore the movement of the outlet shutter member 91 is regulated.

Next, the detaching operation of the toner cartridge from the image forming unit main body 15*a* will be described.

In order to detach the toner cartridge 13 from the image forming unit main body 15*a*, the operator pushes the operating portion 69 of the outlet shutter member 91 to move the outlet shutter member 91 toward the closing position. According to the movement of the outlet shutter member 91, the inlet shutter member 72 also moves toward the closing position. When the outlet shutter member 91 reaches the closing position, the operator recognizes that the outlet shutter member 91 reaches the closing position based on the first operation indicator 49*b*. In this state, the outlet shutter member 91 and the inlet shutter member 72 fully close the toner outlet opening 98 and the toner inlet opening 71 (FIG. 4).

In this state, engagement between the first to-be-locked portion 66 (FIG. 15) of the outlet shutter member and the first locking portion 53 of the developing process cartridge 70 is released. Further, engagement between the second to-be-locked portion 48 (FIG. 18) of the cartridge main body 90 and the second locking portions 56 of the inlet shutter member 72 is released. Therefore, the operator is able to lift the toner cartridge 13 from the image forming unit main body 15*a*.

In a state where the toner outlet opening 98 and the toner inlet opening 71 are fully closed, the outlet shutter member 91 contacts the first regulating portion 45 of the cartridge main body 90 as shown in FIG. 17, and therefore the movement of the outlet shutter member 91 toward the opening position is prevented. That is, an erroneous operation of the outlet shutter member 91 is prevented.

From this state, the operator lifts the guide rib 85 side of the toner cartridge 13 and moves the toner cartridge 13 upward while keeping the toner cartridge 13 inclined, with the result that the toner cartridge 13 is detached from the image forming unit main body 15*a*.

Advantages of the first embodiment of the present invention will be described.

In the case where a grip portion of a toner cartridge and an operating portion of a shutter member are disposed distant from each other and are operated in different directions, operability of the attaching and detaching operation (i.e., replacing operation) is not satisfactory.

In contrast, according to the first embodiment of the present invention, the movable direction of the outlet shutter member 91 coincides with the attaching/detaching direction of the toner cartridge 13 with respect to the image forming unit main body 15*a*. Therefore, the operator is able to move the outlet shutter member 91 in the same direction as the attaching/detaching direction of the toner cartridge 13. That is, the operator is able to intuitively handle the toner cartridge 13 with few motions. Thus, operability of the replacing operation the toner cartridge 13 is enhanced.

Further, since the grip portion 68 and the operating portion 69 (both of which are formed on the outlet shutter member 91) are disposed close to each other, operability of the replacing operation of the toner cartridge 13 is further enhanced.

Furthermore, the outlet shutter member 91 is disposed so as to surround the outer circumference of the cartridge main body 90, and the grip portion 68 and the operating portion 69 are integrally formed with the outlet shutter member 91. Therefore, the size of the toner cartridge 13 can be reduced, and a relatively large amount of toner 14 can be stored in the toner cartridge 13 with respect to the entire volume of the toner cartridge 13.

Second Embodiment

Next, a description will be made of the second embodiment of the present invention. In the description of the second embodiment, components having the same structures as those of the first embodiment are assigned the same reference numerals. Regarding advantages obtained by the components having the same structures as those of the first embodiment, descriptions in the first embodiment are herein incorporated.

Figure 19:
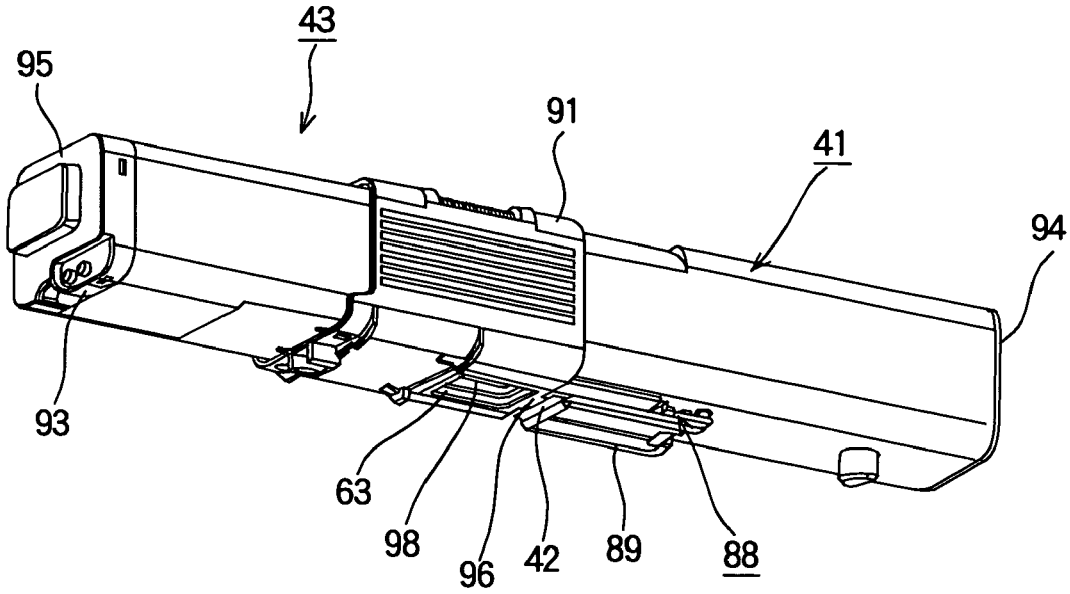
FIG. 19 is a perspective view showing a toner cartridge according to the second embodiment of the present invention in a state where an outlet shutter member is in an opening position.
Figure 20:
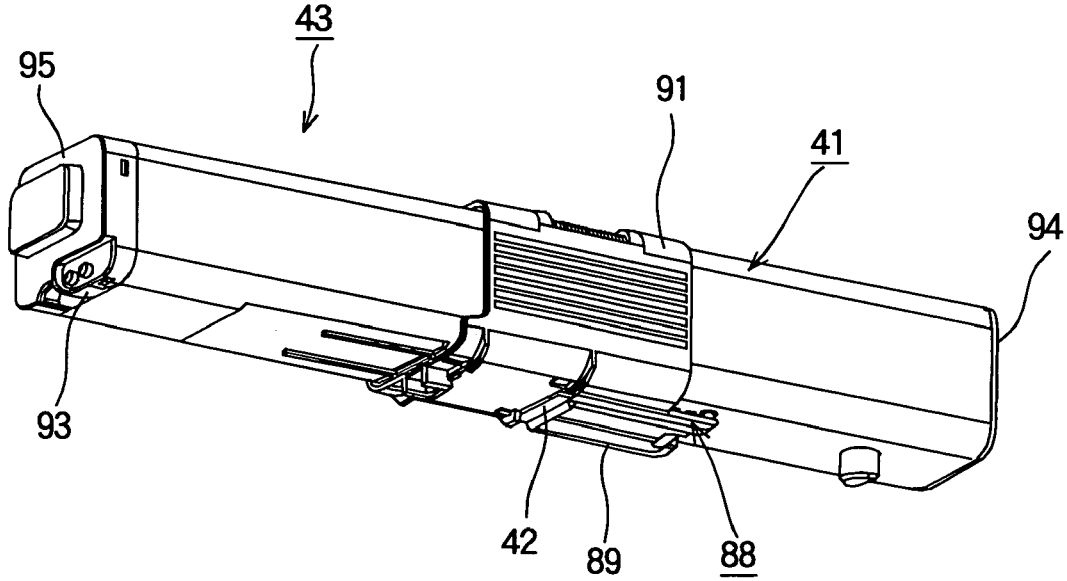
FIG. 20 is a perspective view for illustrating an opening and closing operation of the outlet shutter member according to the second embodiment of the present invention.
Figures 21A, 21B, 21C:
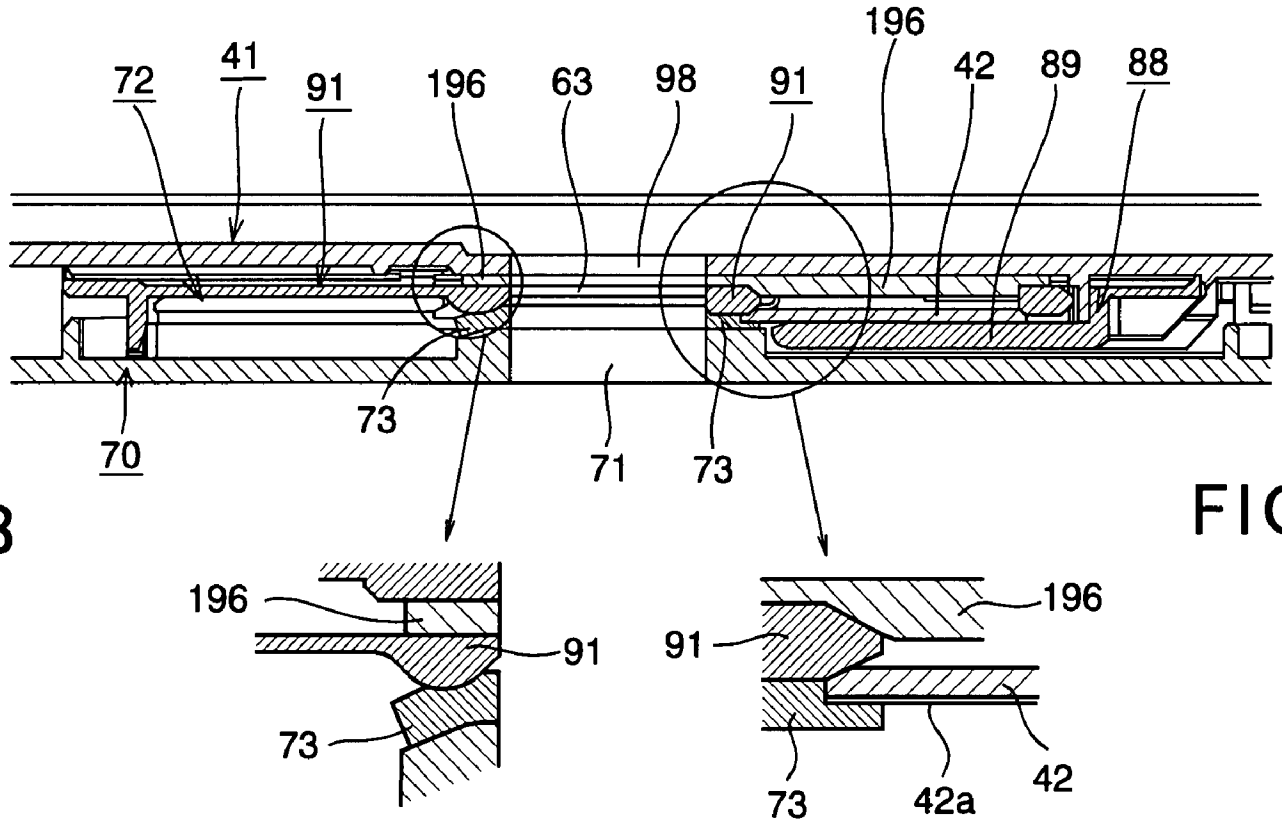
FIG. 21A is a first sectional view for illustrating the opening and closing operation of the outlet shutter member according to the second embodiment of the present invention.
FIGS. 21B and 21C are enlarged sectional views showing encircled parts in FIG. 21A.
Figures 22A, 22B, 22C:
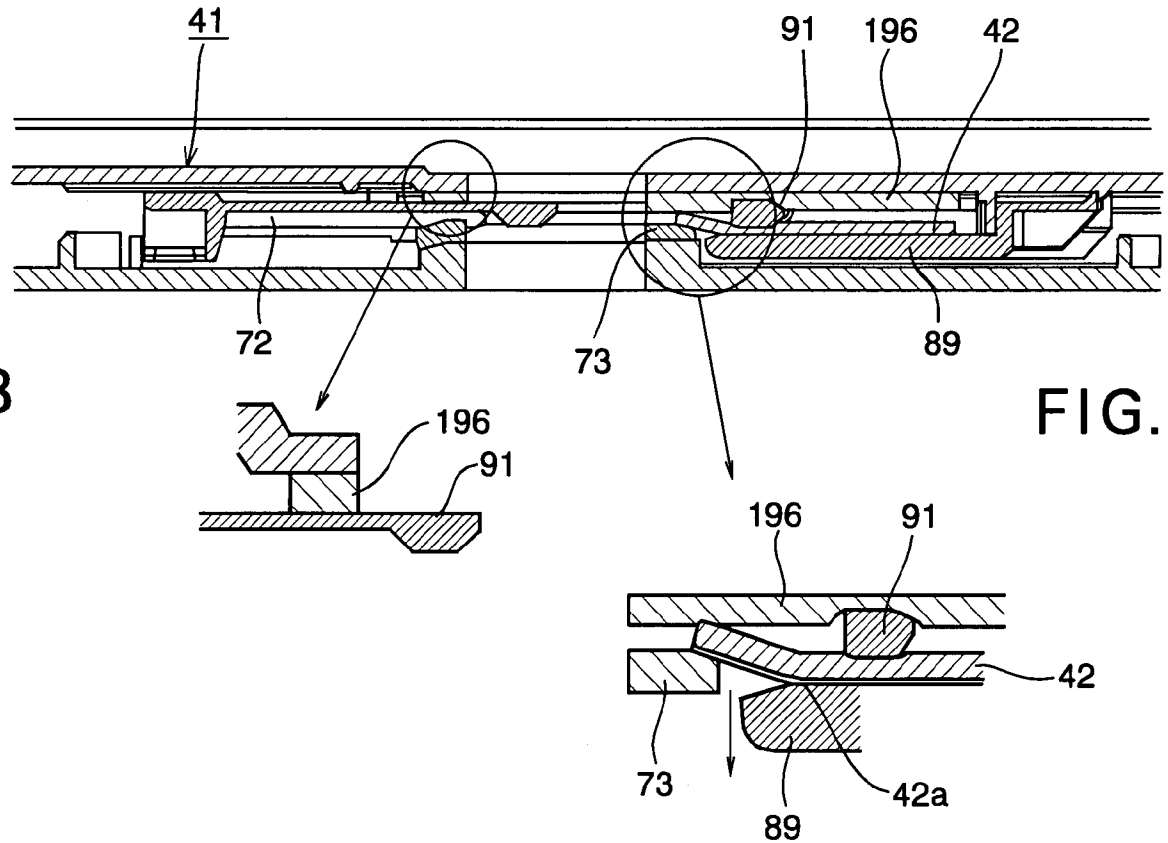
FIG. 22A is a second sectional view for illustrating the opening and closing operation of the outlet shutter member according to the second embodiment of the present invention.
FIGS. 22B and 22C are enlarged sectional views showing encircled parts in FIG. 22A.
Figures 23A, 23B, 23C, 23D:
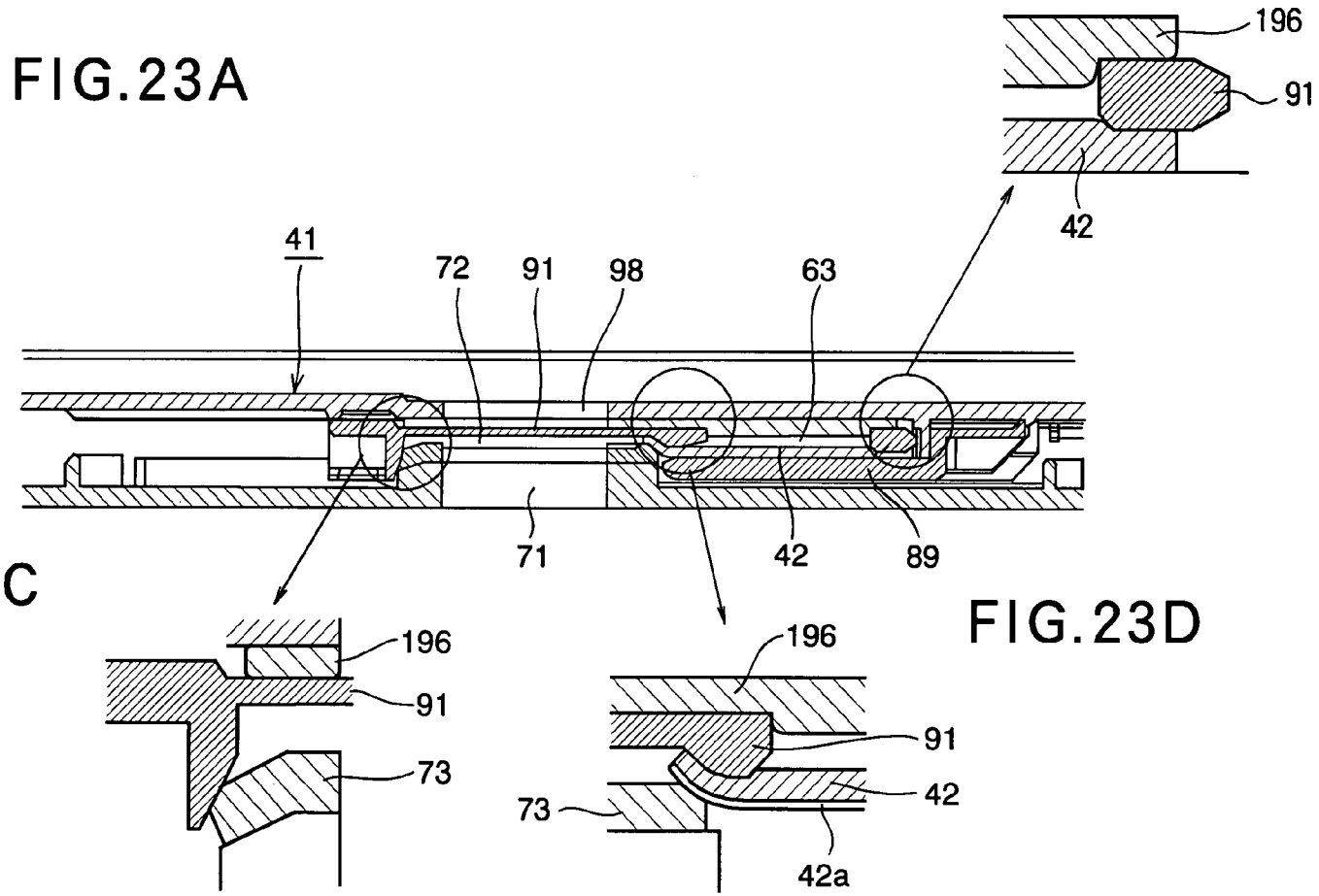
FIG. 23A is a third sectional view for illustrating the opening and closing operation of the outlet shutter member according to the second embodiment of the present invention.
FIGS. 23B, 23C and 23D are enlarged sectional views showing encircled parts in FIG. 23A.

FIG. 19 is a perspective view showing a toner cartridge 43 of the second embodiment of the present invention in a state where the outlet shutter member 91 is in the opening position. FIG. 20 is a perspective view showing the toner cartridge 43 of the second embodiment in a state where the outlet shutter member 91 is in the closing position. FIGS. 21A, 22A and 23A are sectional views showing opening/closing operation of the outlet shutter member 91 according to the second embodiment. FIGS. 21B and 21C are enlarged sectional views showing encircled parts in FIG. 21A. FIGS. 22B and 22C are enlarged sectional views showing encircled parts in FIG. 22A. FIGS. 23B, 23C and 23D are enlarged sectional views showing encircled parts in FIG. 23A.

In this case, the toner cartridge 43 as a developer storing body includes a cartridge main body 41, the outlet shutter member 91, the agitation member 92 (FIG. 7), the agitation driving gear 93 (FIG. 7), the lid member 94, the cover member 95, an outlet seal member 196 (FIG. 21A), the agitation seal member 97 (FIG. 7), a toner withdrawing portion 89 and a withdrawing portion seal member 42.

As shown in FIGS. 21A, 21B and 21C, the outlet seal member 196 is fixed to the cartridge main body 90 by means of adhesion. A bottom surface of the withdrawing portion seal member 42 is covered with a film 42*a*.

Further, the cartridge main body 41 has first regulating portions 88 corresponding to the first regulating portions 78 (FIG. 4) of the first embodiment. The toner withdrawing portion 89 is formed integrally with the first regulating portions 88. The withdrawing portion seal member 42 is fixed to the inner side of the toner withdrawing portion 89 by means of adhesion. The withdrawing portion seal member 42 is compressed between the toner withdrawing portion 89 and the outlet shutter member 91 so as to seal between the toner withdrawing portion 89 and the outlet shutter member 91. For this purpose, a low-friction coating is formed on a sliding surface of the withdrawing portion seal member 42 contacting the outlet shutter member 91, so as not to apply a large load to the outlet shutter member 91 during the movement of the outlet shutter member 91.

The toner withdrawing portion 89 is a portion at which the toner 14 is withdrawn from a connecting portion between the toner outlet opening 98 and the toner inlet opening 71 (via the opening 63 of the outlet shutter member 91) when, for example, the outlet shutter member 91 and the inlet shutter member 72 move from respective opening positions (FIGS. 21A through 21C) to respective closing positions (FIGS. 23A through 23D) in a state where the toner 14 remains in the toner cartridge 43. The provision of the toner withdrawing portion 89 prevents the toner 14 from falling onto the image forming unit main body 15*a* when the outlet shutter member 91 and the inlet shutter member 72 move.

When the outlet shutter member 91 and the inlet shutter member 72 are in the opening positions where the toner outlet opening 98 and the toner inlet opening 71 are connected to each other as shown in FIGS. 21A through 21C, a connection portion therebetween has a thickness equal to a sum of thicknesses of the outlet shutter member 91, the outlet seal member 196 (compressed) and the inlet seal member 73 (compressed). If the image forming unit main body 15*a* is filled with the toner 14 and if the toner cartridge 43 contains remaining toner 14, it means that the toner 14 also exists in the connecting portion between the toner outlet opening 98 and the toner inlet opening 71.

In such a case, when the outlet shutter member 91 and the inlet shutter member 72 move toward the closing positions as shown in FIGS. 22A through 22D, the toner 14 in the connecting portion is pushed by tips of the outlet shutter member 91 and the inlet shutter member 72, so that the toner 14' is pushed out in the moving direction. Such a toner 14 passes the inlet seal member 73 and moves onto the toner withdrawing portion 89 adjacent to the inlet seal member 73, without falling onto the image forming unit main body 15*a*.

Further, when the outlet shutter member 91 and the inlet shutter member 72 reach the respective opening positions as shown in FIGS. 23A through 23D, the toner 14 on the toner withdrawing portion 89 is enclosed in a closed-space defined by the opening 63 of the outlet shutter member 91, the outlet seal member 196 and the withdrawing portion seal member 42. Therefore, the replacing operation of the toner cartridge 43 can be completed without causing the toner 14 to fall onto the image forming unit main body 15*a*.

Further, when the outlet shutter member 91 and the inlet shutter member 72 are again moved toward the opening positions, the toner 14 in the above described closed-space moves back to the connecting portion between the toner outlet opening 98 and the toner inlet opening 71.

According to the second embodiment of the present invention, the toner withdrawing portion 89 is provided, and therefore the toner 14 is prevented from falling onto the image forming unit main body 15*a* and soiling the image forming unit main body 15*a*.

In the above described embodiments, the printer has been described as an example of the image forming apparatus. However, the present invention is applicable to, for example, a copier, a facsimile machine, a combined machine or the like.

While the preferred embodiments of the present invention have been illustrated in detail, it should be apparent that modifications and improvements may be made to the invention without departing from the spirit and scope of the invention as described in the following claims.

What is claimed is:

1. A developer storing body detachably attached to an image forming unit main body of an image forming unit, said developer storing body comprising:

a cartridge main body for storing a developer, said cartridge main body having a developer outlet opening through which said developer is ejected, and an outlet shutter member movable with respect to said cartridge main body so as to open and close said developer outlet opening, wherein a movable direction of said outlet shutter member is substantially the same as a direction in which said developer storing body is attached to and detached from said image forming unit main body.

2. The developer storing body according to claim 1, wherein said movable direction of said outlet shutter member is substantially the same as a longitudinal direction of said developer storing body.

3. The developer storing body according to claim 1, wherein said cartridge main body has a to-be-locked portion which is brought into engagement with a locking portion of said image forming unit main body, and wherein said movable direction of, aid outlet shutter member is substantially the same as a direction in which said to-be-locked portion and said locking portion engage each other.

4. The developer storing body according to claim 3, wherein said to-be-locked portion protrudes in a direction substantially parallel to said movable direction of said outlet shutter member.

5. The developer storing body according to claim 1, wherein said outlet shutter member is configured to surround said cartridge main body.

6. The developer storing body according to claim 1, wherein said outlet shutter member has an operating portion integrally formed therewith.

7. The developer storing body according to claim 1, wherein said cartridge main body has a substantially rectangular cross section.

8. The developer storing body according to claim 1, further comprising a developer withdrawing portion at which a part of said developer is withdrawn when said outlet shutter member moves toward a closing position to close said developer outlet opening.

9. The developer storing body according to claim 8, wherein said developer withdrawing portion is formed integrally with said cartridge main body.

10. The developer storing body according to claim 1, wherein a seal member is provided between said outlet shutter member and said cartridge main body.

11. The developer storing body according to claim 10, wherein said seal member has a sliding surface subjected to low-friction treatment.

12. The developer storing body according to claim 1, further comprising a regulating portion that prevents an erroneous movement of said outlet shutter member.

13. An image forming unit comprising:

said developer storing body according to claim 1, an image forming unit main body to which said developer storing body is detachably attached, wherein said image forming unit main body includes a developing process cartridge with a developer inlet opening for receiving said developer ejected from said developer storing body, and an inlet shutter member for opening and closing said developer inlet opening;

wherein said developing process cartridge has a locking portion that engages a to-be-locked portion of said developer storing body, and wherein said inlet shutter member is movable in conjunction with said outlet shutter member of said developer storing body.

14. An image forming apparatus to which said image forming unit according to claim 13 is mounted.

15. A developer storing body comprising:

a cartridge main body for storing a developer, said cartridge main body having a developer outlet opening through which said developer is ejected, and an outlet shutter member movable with respect to said cartridge main body, said outlet shutter member being moved by an operation of an operating portion so as to open and close said developer outlet opening, wherein said cartridge main body has a protrusion protruding in a predetermined direction, and wherein said outlet shutter member is movable in a direction substantially parallel to said predetermined direction in which said protrusion protrudes.

16. The developer storing body according to claim 15, wherein said protrusion is provided at an end of said cartridge main body in a longitudinal direction thereof, and wherein said operating portion is movable in said longitudinal direction of said cartridge main body.

17. An image forming unit comprising:

said developer storing body according to claim 15, an image forming unit main body to which said developer storing body is detachably attached, wherein said image forming unit main body includes a developing process cartridge having a developer inlet opening for receiving said developer ejected from said developer storing body and an inlet shutter member for opening and closing said developer inlet opening;

wherein said developing process cartridge has a locking portion that engages a to-be-locked portion of said developer storing body, and wherein said inlet shutter member is movable in conjunction said outlet member of said developer storing body.

18. An image forming apparatus to which said image forming unit according to claim 17 is mounted.

* * * * *